US012397192B2

(12) United States Patent
Mapara

(10) Patent No.: US 12,397,192 B2
(45) Date of Patent: Aug. 26, 2025

(54) DYNAMIC FLEXION BOARD

(71) Applicant: MOVEMATE INNOVATIONS, INC., Toronto (CA)

(72) Inventor: Ali Mapara, Ontario (CA)

( * ) Notice: Subject to any disclaimer, the term of this patent is extended or adjusted under 35 U.S.C. 154(b) by 0 days.

(21) Appl. No.: 18/265,520

(22) PCT Filed: Aug. 4, 2022

(86) PCT No.: PCT/IB2022/000455
§ 371 (c)(1),
(2) Date: Jun. 6, 2023

(87) PCT Pub. No.: WO2023/026093
PCT Pub. Date: Mar. 2, 2023

(65) Prior Publication Data

US 2024/0033564 A1 Feb. 1, 2024

Related U.S. Application Data

(60) Provisional application No. 63/237,410, filed on Aug. 26, 2021.

(51) Int. Cl.
*A63B 22/16* (2006.01)
*A63B 26/00* (2006.01)

(52) U.S. Cl.
CPC ..... *A63B 22/16* (2013.01); *A63B 26/003* (2013.01)

(58) Field of Classification Search
CPC . A63B 22/14–18; A63B 26/00; A63B 26/003; A63B 2026/006
See application file for complete search history.

(56) References Cited

U.S. PATENT DOCUMENTS 3,471,144 A * 10/1969 Dreux-Boucard ..... A63B 22/16 482/146
4,739,986 A * 4/1988 Kucharik ..... A63B 23/08 482/79
D315,584 S * 3/1991 Gappa ..... D21/688
6,421,935 B1 * 7/2002 Bartlett ..... A43B 13/143 482/79
10,751,594 B2 * 8/2020 Lee ..... A63C 3/00
2003/0186794 A1 * 10/2003 Vittone ..... A63B 21/4029 482/142

(Continued)

FOREIGN PATENT DOCUMENTS

CA 2961886 A1 * 3/2016 ..... A47C 16/025
DE 20317170 U1 * 4/2004 ..... A63B 22/16

*Primary Examiner* — Nyca T Nguyen
(74) *Attorney, Agent, or Firm* — Gugliotta & Gugliotta LPA

(57) ABSTRACT

A dynamic board is provided that encourages movement and muscle activation in sedentary environments. The board has a flexible planar surface that allows for resistance flexion about multiple spatial planes. The support board is formed of a plurality of linear ribs stacked together in parallel having a lateral central fulcrum hinge running through each linear rib for providing a rotation point for movement along a lateral center axis. A compression element for urging together the plurality of linear ribs and for providing an urging force on each said rib to return to a stasis position about the fulcrum hinge when deflected. Each rib can be formed of a structurally monolithic piece and can have an overall lateral profile similar to an arc segment.

20 Claims, 6 Drawing Sheets

(56) References Cited

U.S. PATENT DOCUMENTS

| | | | | |
|---|---|---|---|---|
| 2004/0014571 | A1* | 1/2004 | Haynes | A63B 26/003 482/142 |
| 2005/0209058 | A1* | 9/2005 | Yu | A63B 22/0056 482/52 |
| 2008/0103034 | A1* | 5/2008 | Mihara | A63B 26/003 482/146 |
| 2020/0238135 | A1* | 7/2020 | Stehlik | A63B 22/18 |

* cited by examiner

DYNAMIC FLEXION BOARD

BACKGROUND OF THE INVENTION

1. Field of the Invention

The present invention is directed to a lower limb stimulation device and, more particularly, to a flexible board to non-disruptively facilitate lower limb flexion about various planes of motion.

2. Description of the Related Art

The first patent for a "balance board" in 1953 anticipated a game balance or entertainment type of device for recreation use that provides a rollable device upon which a person stands and balances by shifting weight. See U.S. Pat. No. 2,764,411 to Washburn Jr. These boards quickly became popular for skiers and surfers to practice their balancing skills in the off season or when natural conditions were poor. Over the years the balance board has come to be used for training in sports and martial arts, for physical fitness and for non-athletic purposes.

In health and fitness uses, such devices have been used to develop balance, motor coordination skills, weight distribution and core strength, and to strengthen ankles and knees in rehabilitation after injuries. Uses of a balance board beyond its athletic origin have become more common: to expand neural networks that enable the left and right hemispheres of the brain to communicate with each other, thereby increasing its efficiency; to develop sensory integration and cognitive skills in children with developmental disorders; to make dancers lighter on their feet; to teach singers optimal posture for the control of air-flow; to teach musicians how to hold their instrument; to shake off writer's block and other inhibitors of creativity; as an accessory to yoga and as a form of yoga, cultivating holistic health, self-awareness and calm.

There are more than a hundred models of balance boards on the market in the United States. Each of them is a version of one of about fifteen types of balance board. Each of these models and types can be classified as one of five basic types of balance board according to two binary parameters: whether its fulcrum is attached to the board and whether the board tilts in only two opposite directions (left and right or forward and back) or in every direction (360 degrees). More specifically: a rocker-roller board is a rocker board whose fulcrum is a separate piece; a sphere-and-ring board is a wobble board whose fulcrum is a separate piece; a wobble board is a rocker board that tilts toward 360 degrees; a sphere-and-ring board is a rocker-roller board that tilts toward 360 degrees; and spring board rests on compression springs that tilts towards 360 degrees.

The use of balanced motion and movements can have health benefits beyond training, entertainment or rehabilitation. The engagement of muscle activation and the encouragement of movement can benefit those in sedentary environments through, inter alia, stimulating overall blood flow by increasing circulation in the lower limbs. However, the uses of any of the conventionally known types of 'balance boards' are not conducive to use in conjunction to sedentary occupations, such as while sitting or standing at a desk.

Consequently, a need exists for a system and device that can promote movement and lower limb circulation to counteract the negative health impact of prolonged sitting in a non-distracting manner while seated at a desk or standing at a standing desk (i.e., while working in an office, etc.)

SUMMARY OF THE INVENTION

It is thus an object of the present invention to provide a dynamic board that encourages movement and muscle activation in sedentary environments.

It is a feature of the present invention to provide a flexible planar surface that allows for resistance flexion about multiple spatial planes.

Briefly described according to the preferred embodiment, a multi-planar flexion board is provided to provide resistance motion to the lower limbs. The board consists of a plurality of linear plates and sections stacked together in parallel. The board is provided that encourages movement and muscle activation in sedentary environments by providing a flexible planar surface that allows for resistance flexion about multiple spatial planes. The support board is formed of a plurality of linear ribs stacked together in parallel having a lateral central fulcrum hinge running through each linear rib for providing a rotation point for movement along a lateral center axis. A compression element for urging together the plurality of linear ribs and for providing an urging force on each said rib to return to a stasis position about the fulcrum hinge when deflected. Each rib can be formed of a structurally monolithic piece and can have an overall lateral profile similar to an arc segment. The central fulcrum hinge may comprise a solid rod at a lateral central axis running through each linear plate provides the fulcrum point for movement along the center axis. An elastic element, such as a nylon bungee, further laced through the linear plates provides a recoil effect and stops the sections from over-rotating, thereby providing balance. The lower surface is curved, enabling the user position at the top surface to tilt their feet fluidly around.

The multi-segmental flat upper surface can be stood upon with or without shoes and is detailed with vertical grooves allowing the user to gauge the appropriate equidistant stance. The sections of wood roll underneath the foot to mimic a massage which stimulates good blood flow in the lower limbs.

With an overall low vertical height, the board can be adapted for use at a standing desk or in any number of environments where a user is forced to remain sedentary in a standing position for extended periods.

Resistance provided about multiple axes challenging a user's core muscles but does so in a manner as to not distract the user from being productive at the same time.

The unique design, construction and operation promote movement, flexibility and comfort simultaneously.

Further objects, features, elements and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
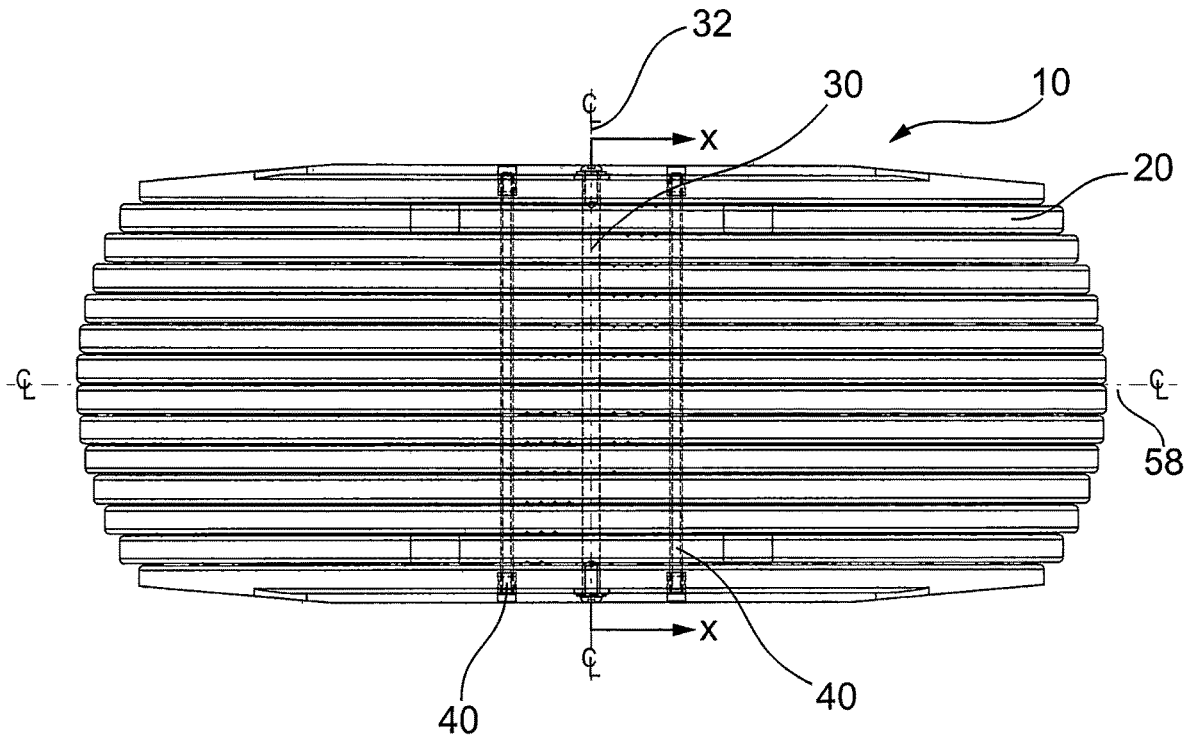
FIG. 1 is a top plan view of a dynamic, resistance flexion board according to the preferred embodiment of the present invention.
Figure 2:
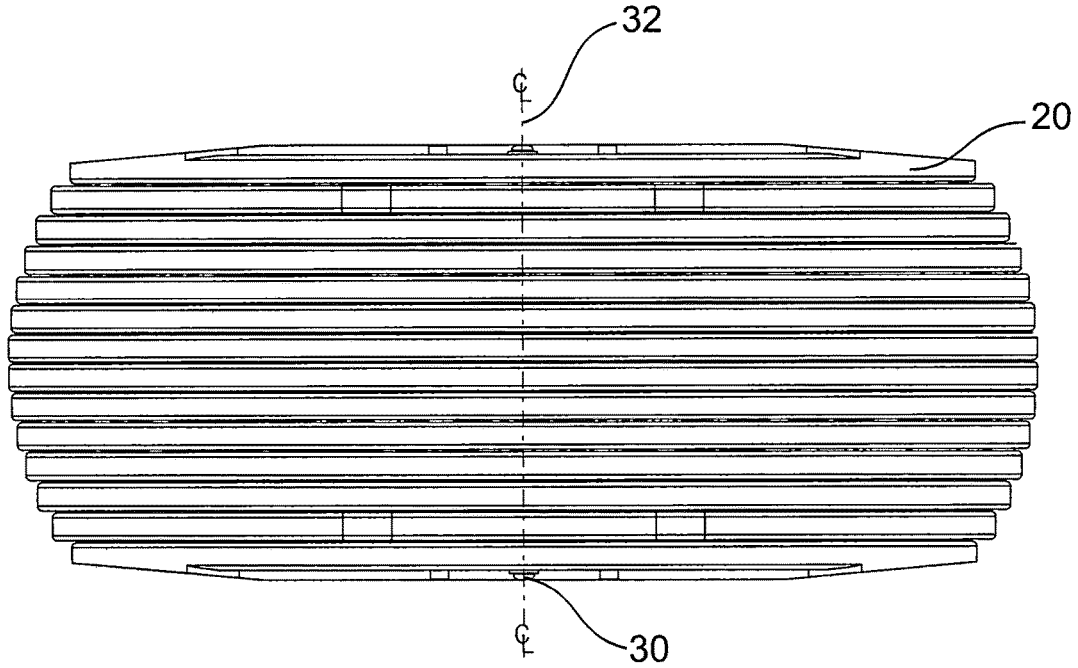
FIG. 2 bottom plan view thereof.
Figure 3:
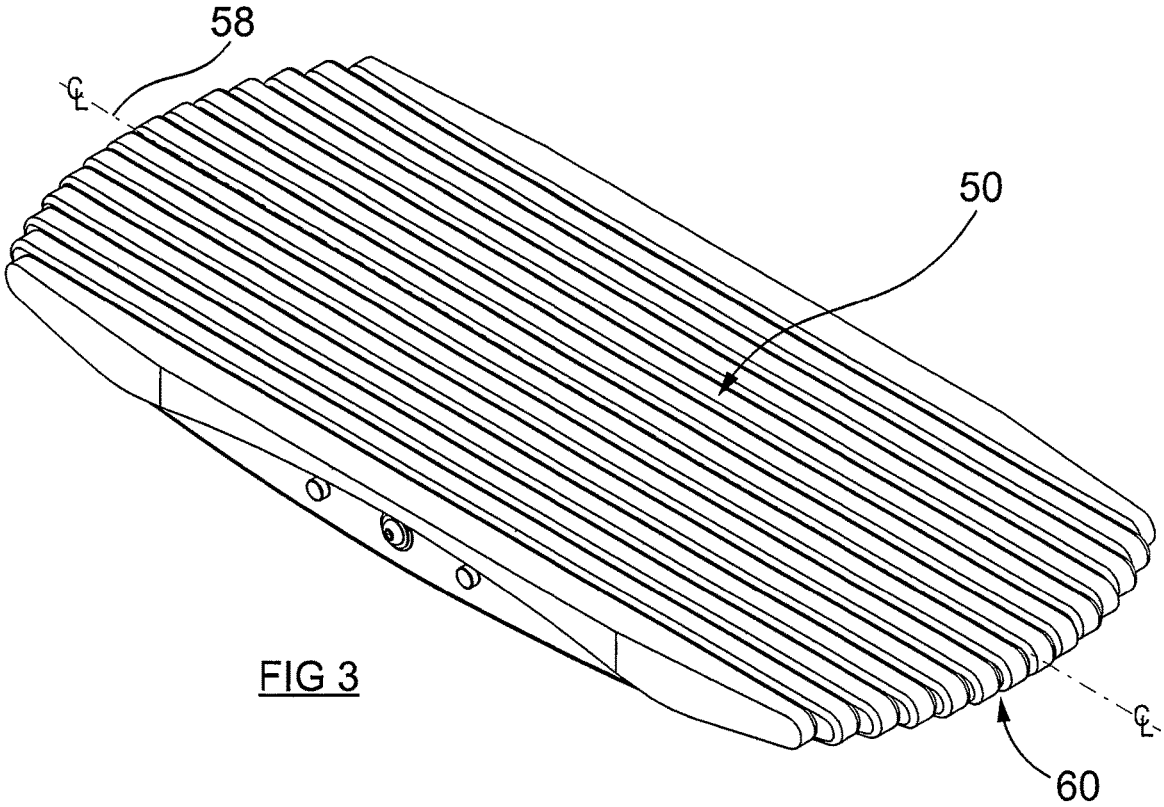
FIG. 3 is a perspective view thereof.
Figure 4:
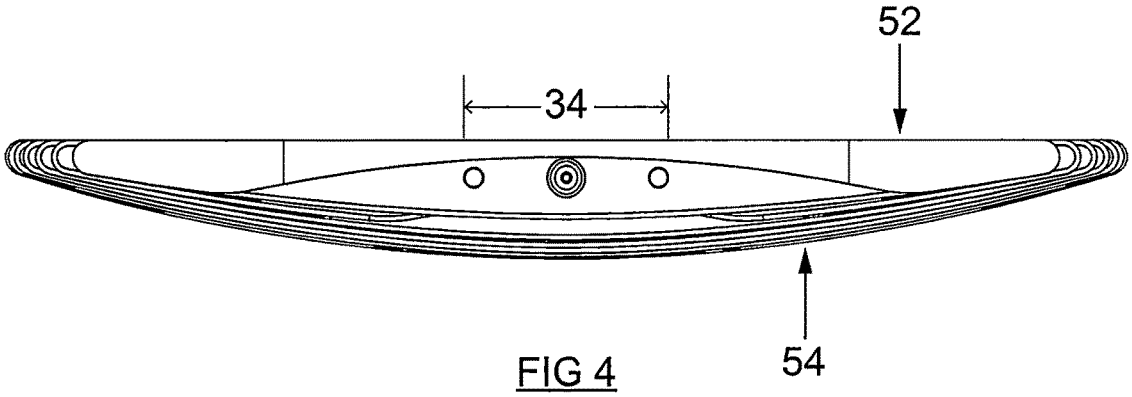
FIG. 4 is a side elevational view thereof, the opposite side being a mirror image.
Figure 5:
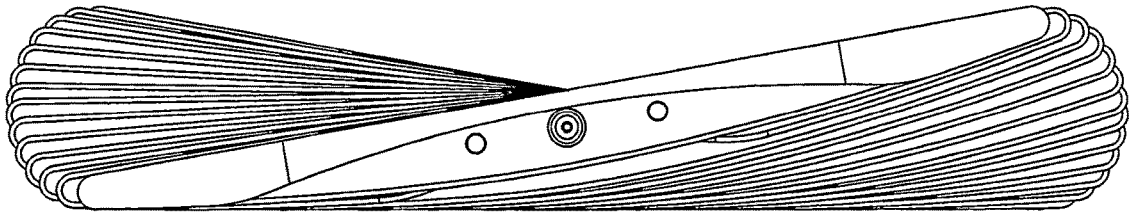
FIG. 5 is the side elevational view of FIG. 4, shown with the ribs 20 flexed to form a curvilinear upper surface.
Figure 6:
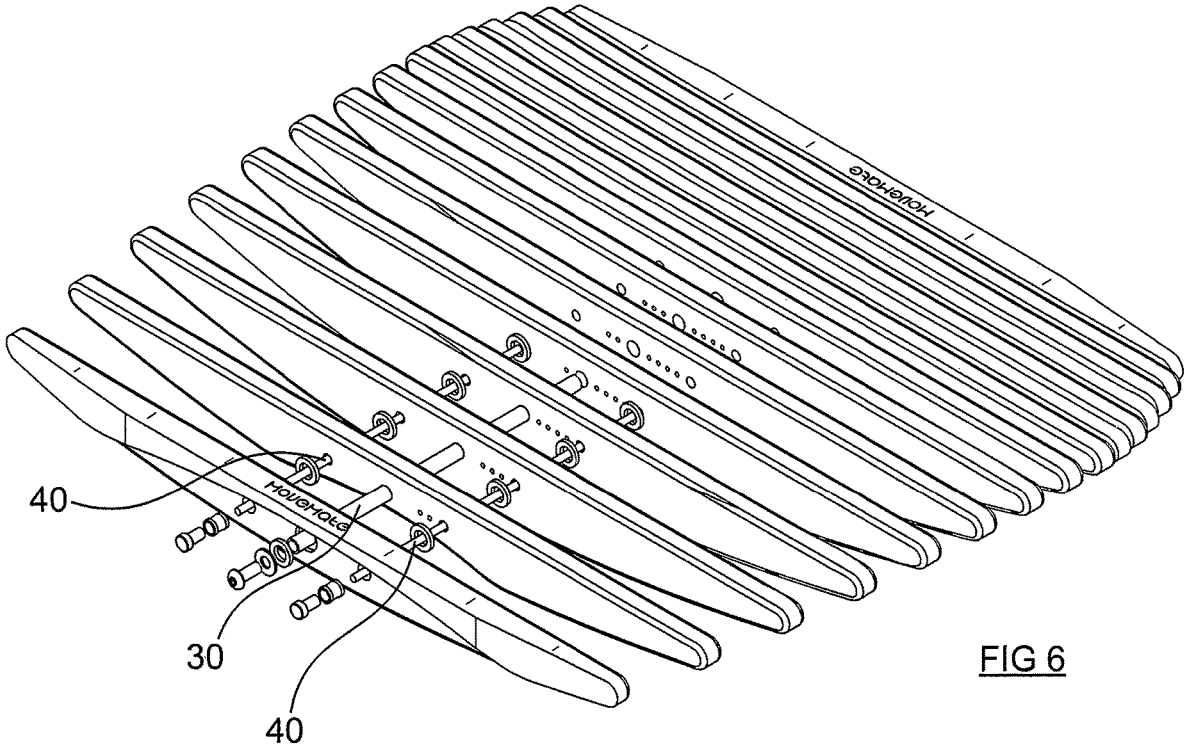
FIG. 6 is a partially exploded upper perspective view of the dynamic, resistance flexion board according to the preferred embodiment of the present invention.
Figure 7:
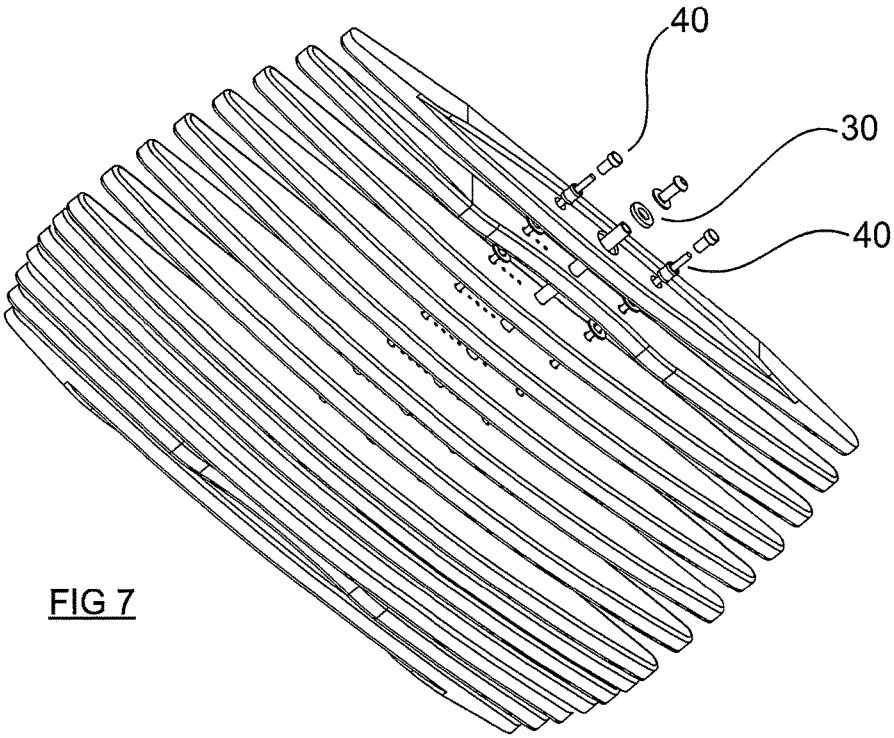
FIG. 7 is a partially exploded lower perspective view thereof.
Figure 8:
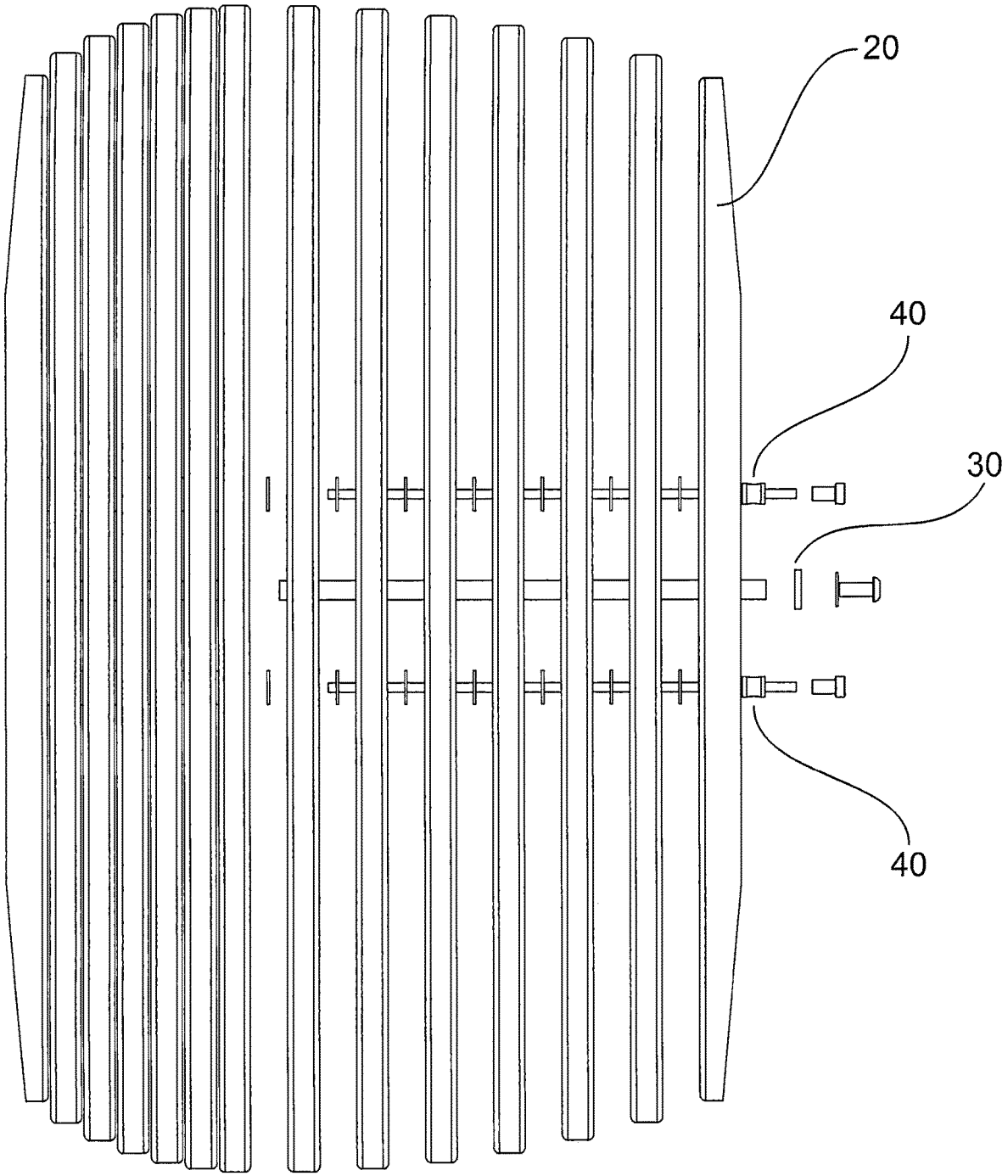
FIG. 8 is a partially exploded top plan view thereof.
Figure 9:
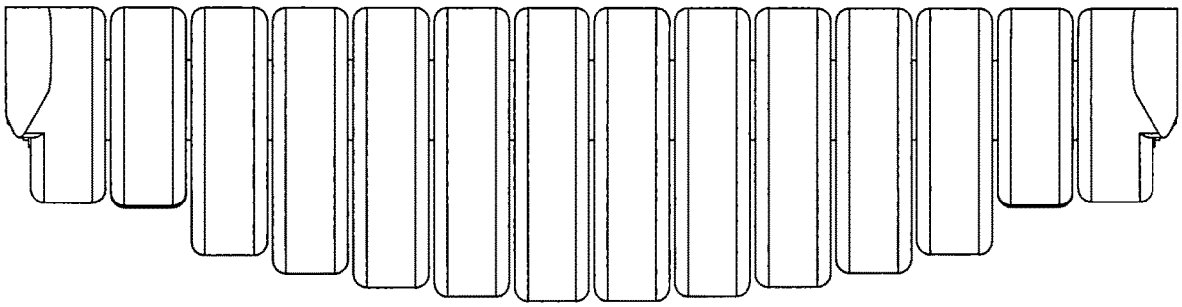
FIG. 9 is a front elevational view thereof.
Figure 10:
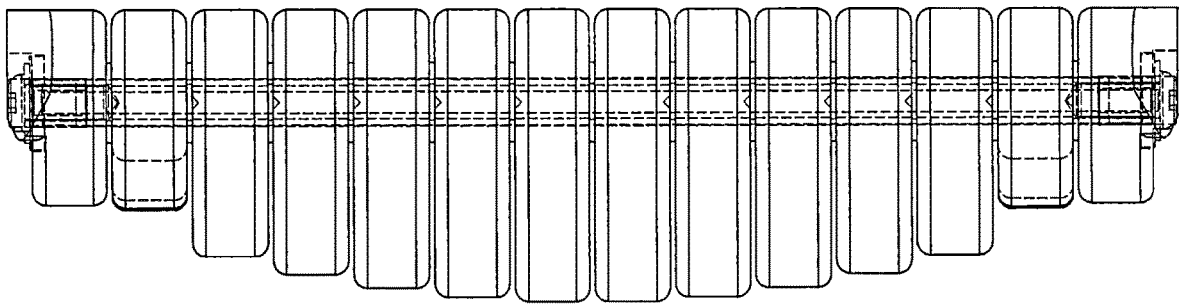
FIG. 10 is a cross sectional view taken along line X-X of FIG. 1 (intentionally left blank).
Figure 11:
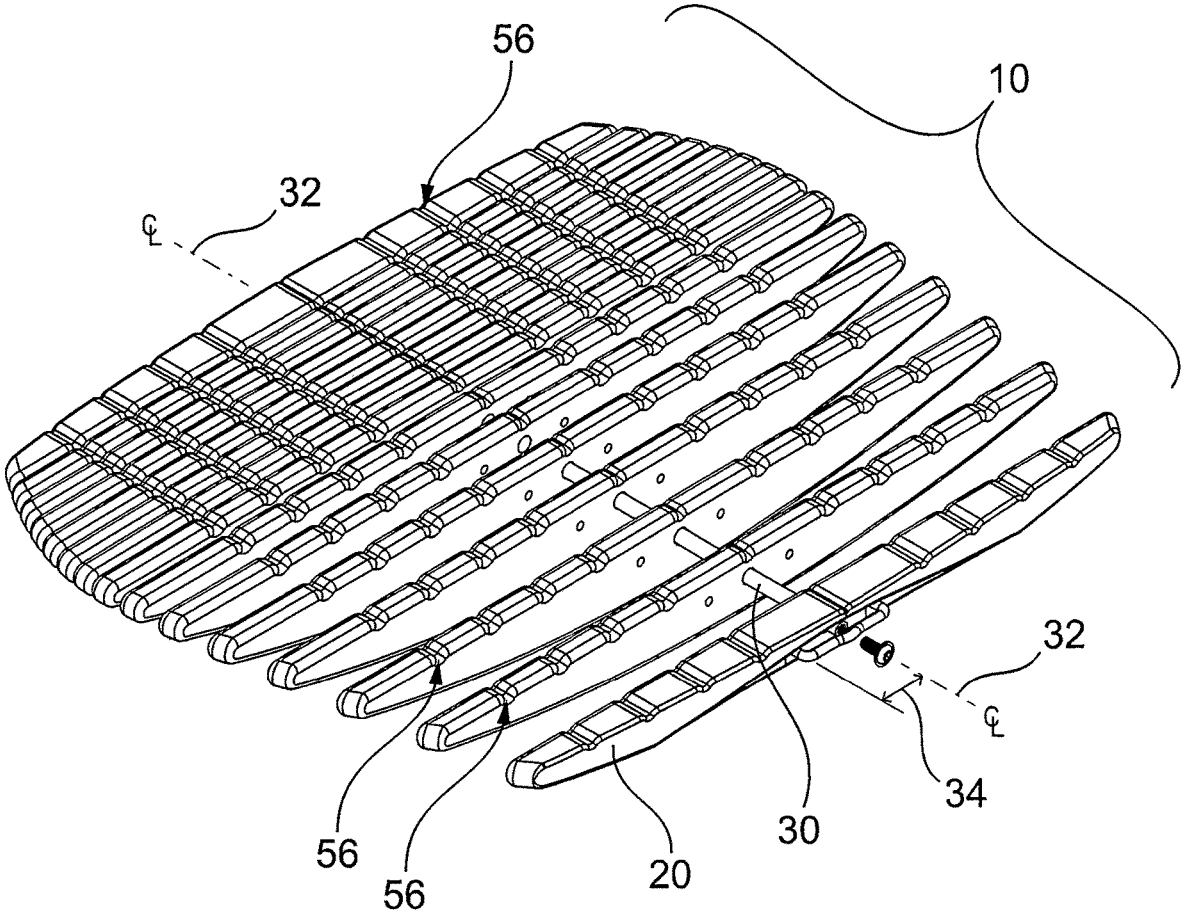

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

The best mode for carrying out the invention is presented in terms of its preferred embodiment, herein depicted within the Figures.

1. Detailed Description of the Figures

Referring now to the drawings, wherein like reference numerals indicate the same parts throughout the several views, a support board, generally noted as 10, is shown according to a preferred embodiment of the present invention designed and adapted to provide resistance motion to the lower limbs. The support board 10 is formed of a plurality of linear ribs or plates 20 formed into sections stacked together in parallel as further described in greater detail below. Each individual rib 20 may be a single piece (e.g., monolithic piece) or formed of multiple plies mechanically connected so as to function as a single integrated element. The ribs 20 are preferably each made of wood, and more preferably each made of an engineered material such as a plywood material, i.e., manufactured from thin layers or "plies" of wood veneer that are glued together with adjacent layers having their wood grain rotated up to 90 degrees to one another. The ribs 20 may alternately be formed of a different engineered wood, including from a group of manufactured materials including medium-density fiberboard (MDF), oriented strand board (OSB) and particle board (chipboard).

In other or alternate configurations, the ribs 20 may be made of other suitable and functionally equivalent materials, such as molded plastic, metal (such as aluminum), other polymer material, a composite material, or a combination of different materials, etc.

In any embodiment, the ribs 20 may be assembled in a manner that is spaced apart, thereby allowing for movement of individual ribs 20 without impinging against adjacent ribs. In a preferred embodiment a spacing between ribs would be equal to or less than a dimension that could result in a user's foot or toes becoming accidentally wedged within the spacing. In a more preferred embodiment, the spacing would be between about 0.5 mm to about 10 mm. In an even more preferred embodiment, the spacing would be about 1.5 mm.

A central axis rod 30 is provided at a lateral centerline 32. The lateral centerline 32 forms an axis running through each rib 20 providing a fulcrum point for pivoting movement about the center axis 32.

An elastic element 40 is further provided. The elastic element 40 may be provided in the form of a nylon bungee or other similar, functionally equivalent member (e.g., rubber, spring, etc.) that can provide compression to the ribs 20 inwardly to compress the plurality of parallel ribs 20 together. As shown herein, the bungee 40 is laced laterally through the linear ribs 20 in a manner offset 34 from and parallel to the central axis rod 30. This combination of tension and parallel offset about the centerline 32 provides a recoil effect that urges the ribs 20 to remain parallel and provides a resistance to their rotation.

The plurality of ribs 20 when arranged adjacent and parallel form a support platform, generally 50, at an upper surface 52. The upper surface 52 may be substantially flat. Opposite the support platform 50 is a lower surface, generally 54. The lower surface 54 may be generally curved along a linear centerline 58. With a flat upper surface 52 and curved lower surface 54, each rib 20 may have an overall lateral profile similar to an arc segment.

With the lower surface 54 being curved along the linear centerline 58 the entire board 10 can be rocked about that axis along the lower surface 54. In order to create the ability to similarly rock the board 10 about the lateral centerline 32, each adjacent rib 20 may be successively taller up through the linear centerline. The alignment of incrementally larger ribs 20 may further form a secondary segmented curved 60 about the lateral axis 32. By forming a curve along each lateral and linear axis, the lower surface 54 forms a compound curve that is generally domed.

The upper surface 50 may further include a grip enhancement, such as a plurality of notches 56 formed along the top of each rib 20. Alternate grip enhancements may be provided and should be broadly construed to include any functionally equivalent method including, but not limited to, other textures, materials, or coatings to provide such functionality.

2. Operation of the Preferred Embodiment

In operation, the support board 10 may provide a dynamic board that encourages movement and muscle activation in sedentary environments. The planar upper surface 52, being formed of a series of elastically compressed ribs 20, provides a flexible planar surface that allows for resistance flexion about multiple spatial planes. One of skill in the art will recognize that while the devices described herein may be used in various situations and environments, such as a platform for use in a work environment or as a balance boards during therapy or fitness, described broadly intended uses enabled by the structure, features and functions of the present invention should not be considered to be limiting of the scope of the invention. As such, the multi-segmental flat upper surface can be stood upon, with or without shoes, with the grooves formed within the upper surface providing both traction as well as to stimulate a user's feet. Further, the movement of the ribs 20 about multiple planes, and the rolling of the platform about the curved lower surface, each facilitate an action to mimic a massage which stimulates good blood flow in the lower limbs.

With an overall low vertical height, the board 10 can be adapted for use at a standing desk or in any number of environments where a user is forced to remain sedentary in a standing position for extended periods. Resistance being provided about multiple axes challenge a user's core muscles but does so in a manner as to not distract the user from being productive at the same time. These capabilities, when implemented in regular use, can address problems associated with sedentary living, and also can enhance the speed and quality of ankle rehabilitation programs, without distracting people from what they need and want to do. Such use of the dynamic flexion board enables controlled lower leg angular movements that mimic the range of motion of walking in order to activate muscles and joints, engage the core, enable proper posture and facilitate Non-Exercise Activity Thermogenesis (NEAT).

By providing the ability to "move" these muscles and joints during work and leisure activities where one would otherwise typically be sedentary (sitting or standing still), such benefits may be generated in a variety of settings, such as during work activities (working while sitting or standing, working while sitting, reading, brainstorming, calls, in-person meetings etc.), during leisure activities (using social media, reading, watching tv/videos, gaming, socializing, listening to music/podcasts etc.), or in rehabilitation application. By facilitating an increase in the overall adherence to, and effectiveness of, ankle rehabilitation programs, the use of the dynamic flexion board allows faster and fuller recoveries. Enabling all directional movements (plantarflexion, dorsiflexion, inversion, eversion) of the ankle joint simultaneously activates surrounding muscles, tendons and ligaments to reduce stiffness, increase strength, improve range of motion, enhance endurance and improve proprioception. Controlled movements of the ankle joint allow edemas and effusions to subside quicker. Gentle uses of the anterior and posterior muscles of the entire leg promote increased circulation. Improved circulation gets the unhealthy fluid out and healthy blood and nutrients into the injury to help it heal fully and quickly.

Designed for multitasking, the present invention can be used in conjunction with a variety of work and leisure activities that would otherwise be considered sedentary. Given that the motion provided improves the strength, endurance, flexibility and range of motion of the ankle, people are able to continue rehabilitating their ankle during their regular daily activities thus compensating for the lack of time, forgetfulness and laziness that leads to people not doing their home exercise routines to rehabilitate their ankle typically affects the duration and quality of their recovery and increases chances of future reinjury.

Also, by providing the ability to achieve dorsiflexion and plantarflexion that mimics the motion of walking, range of motion can be extended to a larger degree to better stretch and strengthen ligaments and supporting muscles and promote blood circulation. Such use can prevent locking of joints (ankle and knee) due to inactivity, facilitate non-exercise activity thermogenesis (NEAT), or the energy expended for all activities that are not sleeping, eating or structured exercise (i.e., walking, cleaning, gardening, washing dishes, stretching).

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

I claim:

1. A support board comprising a flexible planar surface that allows for resistance flexion about multiple spatial planes and comprising:

a plurality of linear ribs stacked together in parallel and adapted to allow each of the plurality of linear ribs to move about a lateral central fulcrum hinge;

said lateral central fulcrum hinge running through each linear rib for providing a rotation point for movement along a lateral center axis;

a compression element for urging together the plurality of linear ribs and for providing an urging force on each said rib to return to a stasis position about the fulcrum hinge when deflected.

2. The support board of claim 1, wherein each of said plurality of ribs is formed of a structurally monolithic piece.

3. The support board of claim 1, wherein each rib has an overall lateral profile similar to an arc segment.

4. The support board of claim 2, wherein each rib has an overall lateral profile similar to an arc segment.

5. The support board of claim 4, wherein each of said plurality of ribs is formed of a material selected from a group consisting of: wood; molded plastic; metal; aluminum; a polymer material; a composite material; and a combination of different materials within the group.

6. The support board of claim 1, wherein the compression element compresses the plurality of parallel ribs and provides an urging force offset about the lateral center axis, thereby providing a recoil effect that urges the ribs to remain parallel and provides a resistance to the rotation of the ribs.

7. The support board of claim 2, wherein the compression element compresses the plurality of parallel ribs provides an urging force offset about the lateral center axis, thereby providing a recoil effect that urges the ribs to remain parallel and provides a resistance to the rotation of the ribs.

8. The support board of claim 3, wherein the compression element compresses the plurality of parallel ribs provides an urging force offset about the lateral center axis, thereby providing a recoil effect that urges the ribs to remain parallel and provides a resistance to the rotation of the ribs.

9. The support board of claim 4, wherein the compression element compresses the plurality of parallel ribs provides an urging force offset about the lateral center axis, thereby providing a recoil effect that urges the ribs to remain parallel and provides a resistance to the rotation of the ribs.

10. The support board of claim 5, wherein the compression element compresses the plurality of parallel ribs provides providing an urging force offset about the lateral axis, thereby providing a recoil effect that urges the ribs to remain parallel and provides a resistance to the rotation of the ribs.

11. The support board of claim 1, further comprising:

upper surface being substantially flat;

a lower surface generally curved along a linear centerline and along a lateral centerline.

12. The support board of claim 2, further comprising:
upper surface being substantially flat;
a lower surface generally curved along a linear centerline and along a lateral centerline.

13. The support board of claim 3 further comprising:
upper surface being substantially flat;
a lower surface generally curved along a linear centerline and along a lateral centerline.

14. The support board of claim 4 further comprising:
upper surface being substantially flat;
a lower surface generally curved along a linear centerline and along a lateral centerline.

15. The support board of claim 5, further comprising:
upper surface being substantially flat;
a lower surface generally curved along a linear centerline and along a lateral centerline.

16. The support board of claim 6, further comprising:
upper surface being substantially flat;
a lower surface generally curved along a linear centerline and along a lateral centerline.

17. The support board of claim 7, further comprising:
upper surface being substantially flat;
a lower surface generally curved along a linear centerline and along a lateral centerline.

18. The support board of claim 8, further comprising:
upper surface being substantially flat;
a lower surface generally curved along a linear centerline and along a lateral centerline.

19. The support board of claim 9, further comprising:
upper surface being substantially flat;
a lower surface generally curved along a linear centerline and along a lateral centerline.

20. The support board of claim 10, further comprising:
upper surface being substantially flat;
a lower surface generally curved along a linear centerline and along a lateral centerline.

* * * * *